US009415434B2

(12) United States Patent
Blei et al.

(10) Patent No.: US 9,415,434 B2
(45) Date of Patent: Aug. 16, 2016

(54) DOWNHOLDER CONTROL IN THE MANUFACTURE OF CAN BODIES

(75) Inventors: Klaus Blei, Wangen (DE); Martin Gaebges, Albershausen (DE); Gerhard Pick, Wäschenbeuren (DE); Roland Schmid, Schlat (DE)

(73) Assignee: SCHULER PRESSEN GMBH & CO. KG, Göppingen (DE)

( * ) Notice: Subject to any disclaimer, the term of this patent is extended or adjusted under 35 U.S.C. 154(b) by 984 days.

(21) Appl. No.: 13/068,106

(22) Filed: May 2, 2011

(65) Prior Publication Data

US 2011/0265545 A1 Nov. 3, 2011

(30) Foreign Application Priority Data

May 3, 2010 (DE) ..... 10 2010 019 323

(51) Int. Cl.

| | |
|---|---|
| ***B21D 24/10*** | (2006.01) |
| ***B21D 24/12*** | (2006.01) |
| ***B21D 22/28*** | (2006.01) |
| ***B21D 51/26*** | (2006.01) |

(52) U.S. Cl.

CPC ..... *B21D 24/10* (2013.01); *B21D 22/28* (2013.01); *B21D 24/12* (2013.01); *B21D 51/26* (2013.01)

(58) Field of Classification Search

CPC ..... B21D 22/28; B21D 51/26; B21D 24/10; B21D 26/039; B21D 24/12

USPC ..... 72/351, 347, 349; 413/1, 76

See application file for complete search history.

(56) References Cited

U.S. PATENT DOCUMENTS

| | | | | | |
|---|---|---|---|---|---|
| 4,414,836 | A | * | 11/1983 | Saunders | 72/349 |
| 4,702,098 | A | * | 10/1987 | Pora et al. | 72/351 |
| 5,212,977 | A | | 5/1993 | Stuart | |
| 5,357,779 | A | | 10/1994 | Hahn et al. | |
| 5,477,723 | A | * | 12/1995 | Kergen | 72/350 |

FOREIGN PATENT DOCUMENTS

| | | |
|---|---|---|
| DE | 10 2008 038 263 A1 | 2/2010 |
| WO | WO 2009/052608 A1 | 4/2009 |

* cited by examiner

*Primary Examiner* — Shelley Self
*Assistant Examiner* — Mohammad I Yusuf
(74) *Attorney, Agent, or Firm* — R. S. Lombard; K. Bach

(57) ABSTRACT

The invention concerns an arrangement (20) and a method for the manufacture of can bodies from pot-shaped blanks (37). To this end, the blank (37) is inserted into a bottom tool part (45). The blank (37) is clamped between a downholder (23) and a counter support surface (47) of the lower tool part (45). For controlling a position value α determining the position and/or position change of the downholder (23), a drive arrangement (22) is provided. The drive arrangement controls the position value in accordance with a predetermined course, so as to move the downholder (23) into the clamping position or out of the clamping position EP. As soon as the downholder (23) reaches its clamping position EP, the drive unit (22) controls a force value in accordance with a predetermined course which determines the clamping force F(t) which is applied by the downholder (23) to the blank (37). This occurs preferably by an adjustment of the motor current I to a predetermined course of the desired value $I_E(t)$.

7 Claims, 7 Drawing Sheets

DOWNHOLDER CONTROL IN THE MANUFACTURE OF CAN BODIES

CROSS-REFERENCE TO RELATED APPLICATION

This application claims the priority of German Application No. 10 2010 019 323.2-14 filed May 3, 2010.

BACKGROUND OF THE INVENTION

The invention concerns an arrangement and a method for the manufacture of can bodies, for example, for pressure container or beverage cans. Herein a pot-shaped blank is formed by means of a deep-draw plunger into the can body. The can body includes a can bottom and a can wall consisting of the same material and extending from the can bottom without joint. At the end, opposite the can bottom, the can body is open. In order to be able to form the pot-shaped blank, it is engaged by a downholder between the downholder and a counter element. Subsequently, a drawing plunger can transform the blank into the can body, in particular, by so-called deep-draw presses.

WO 2009/052608 A1 discloses an arrangement or, respectively, a method whereby from a planar billet first a pot-shaped blank is formed by drawing the flat billet over a hollow-cylindrical projection. Subsequently, the bottom of the pot-like blank is pressed by a plunger into the hollow cylindrical projection whereby the blank is so-to-say inverted.

It is the object of the present invention, to provide a method and an apparatus for the manufacture of a can body which reduces the material stresses on the blank.

SUMMARY OF THE INVENTION

The invention concerns an arrangement (20) and a method for the manufacture of can bodies from pot-shaped blanks (37). To this end, the blank (37) is inserted into a bottom tool part (45). The blank (37) is clamped between a downholder (23) and a counter support surface (47) of the lower tool part (45). For controlling a position value $\alpha$ determining the position and/or position change of the downholder (23), a drive arrangement (22) is provided. The drive arrangement controls the position value in accordance with a predetermined course, so as to move the downholder (23) into the clamping position or out of the clamping position EP. As soon as the downholder (23) reaches its clamping position EP, the drive unit (22) controls a force value in accordance with a predetermined course which determines the clamping force F(t) which is applied by the downholder (23) to the blank (37). This occurs preferably by an adjustment of the motor current I to a predetermined course of the desired value $I_E(t)$.

In accordance with the invention, the pot-shaped blank is clamped between a downholder and a counter element. To this end the downholder is moved by a drive arrangement from a rest position to a clamping position. During the movement, the drive arrangement controls a position value which characterizes the position or the position change of the downholder, such as the rotational position of an electric motor. The counter element is generally stationary and may be, for example, part of a lower tool. After reaching the clamping position, the drive arrangement switches automatically over and controls a force value characterizing the clamping force. This may occur, for example, by controlling the motor torque of an electric motor. In the clamping position, therefore, the clamping force desired for the subsequent transformation of the blank into a can body is controlled. An excessive clamping force may result in a rupture of the material of the blank. With an insufficient clamping force on the other hand, kinks or folds may be formed in the can body. With the force-or-torque control driving the clamping of the blank by the downholder which, preferably, follows a freely programmable desired value curve, the quality of the can body produced is improved.

For the transformation and particularly the deep draw pressing of the blank into the can body preferably a drawing plunger arranged co-axially with the downholder is provided. In particular, the drawing plunger may extend coaxially through a tubular downholder. For actuating the drawing plunger, a plunger drive is provided which is controllable independently of the drive arrangement.

The position value and/or the force strength may be provided as variables. The position value and/or the force value may be provided depending on a guide value and/or depending on the time. The predetermined values are preferably freely programmable and stored, for example, in a control unit.

After occurrence of a certain event, it is switched between the position-or pilot control and a force-or torque control. For example, the beginning and the end of the force-or torque control on the basis of a change in a guide value, in particular, a virtual guide angle is determined. The control of the force value is, for example, terminated when the virtual guide angle has reached a predetermined threshold value. With a sine-like changing guide angle this may be the case when, since the point in time at which the downholder has reached the clamping position, a predetermined time has lapsed. The predetermined time period is adapted to the needed duration for the transformation of the blank to a can body. After the time period has passed or the predetermined guide angle value has been reached, the drive arrangement switches the control from the force or torque control to the position control and moves the downholder out of the clamping position back to its original rest position. Subsequently, the procedure begins anew.

The guide angle may follow a course of a periodic oscillation with constant frequency, in particular a sine-shaped curve. By means of the guide angle several drives of the arrangement may be synchronized with one another, for example, the drive arrangement for the downholder and the separately controlled plunger drive.

In a preferred embodiment of the arrangement according to the invention, the drive arrangement includes an electric motor, in particular a synchronous motor. For the position control, the desired angular position is adjusted based on the motor voltage. For the control of the clamping force, the motor torque is correspondingly controlled, for example, on the basis of the motor current. An electric motor is easily and accurately adjustable with respect to its rotational position as well as the motor torque. By way of the electric motor extremely high stroke speeds can be achieved. The arrangement operates with a stroke number in the area of 400 to 500 and, preferably, 460 $min^{-1}$. The whole cycle for the deep draw pressing to manufacture a can body from the blank takes about 120 to 150 ms, i.e., milliseconds. The stroke is in the range of 400 to 800 mm, i.e., millimeters, preferably 600 mm.

Alternatively, it would also be possible to provide a fluid cylinder such as a hydraulic cylinder or a pneumatic cylinder as drive device. For controlling the clamping force then the pressure in the fluid cylinder is controlled in accordance with a predetermined desired value curve. However, presently available fluid drives do not reach the stroke numbers which can be obtained with an electric motor.

BRIEF DESCRIPTION OF THE DRAWINGS

Advantageous features of the invention are apparent from the drawings exemplary of the invention, in which.

DETAILED DESCRIPTION OF VARIOUS EMBODIMENTS

Figure 1:
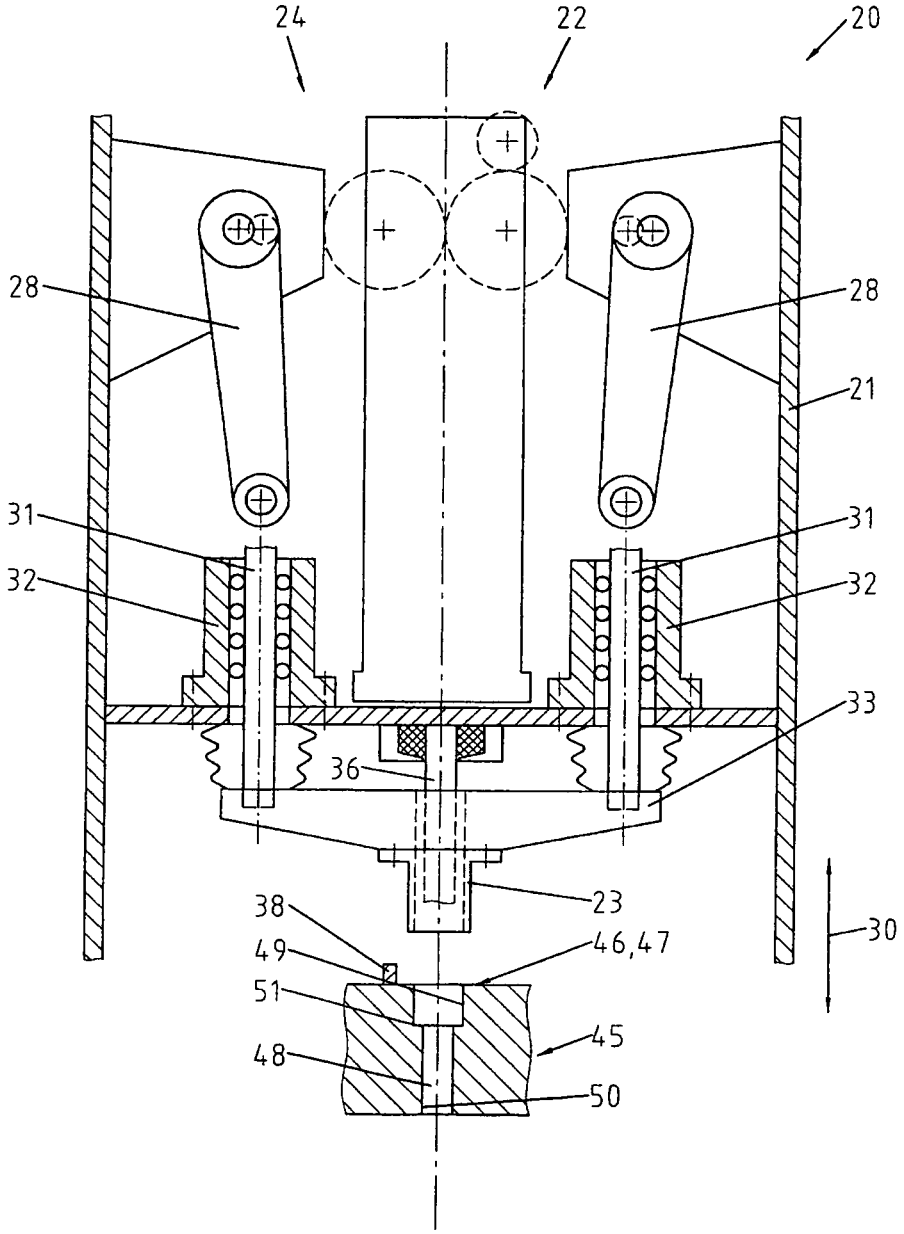
FIG. 1 is an exemplary embodiment of an arrangement for the manufacture of can bodies in a schematic cross-sectional presentation.
Figure 2A:
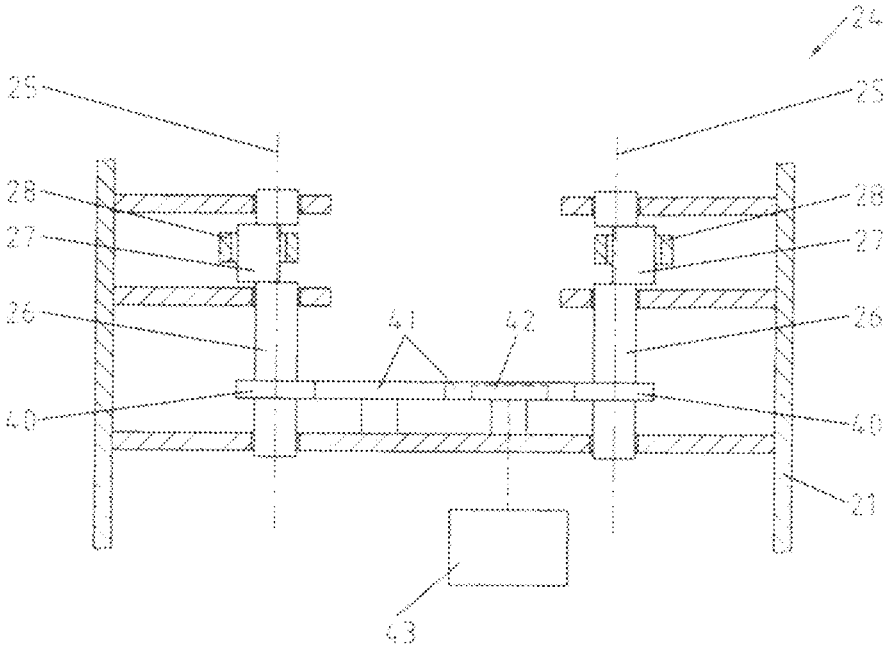
FIG. 2A is a representation of a crank drive of the arrangement shown in FIG. 1 in a cross-sectional view.

FIGS. 1 and 2*a* show a first exemplary embodiment of an arrangement 20 for the manufacture of can bodies. The arrangement 20 includes a frame 21 on which a drive arrangement 22 for moving and applying pressure to a downholder 23 is arranged. The drive arrangement 22 includes a crank drive 24 with several crankshafts, for example, two crankshafts 26 which are rotatably supported on the frame 21 so as to be rotatable each about a crankshaft axis 25. Each crankshaft 26 includes a crank 27 which is arranged eccentrically with respect to the crankshaft axis 25. In each crank 27 a connecting rod 28 is supported. At the end of the connecting rod 28, opposite the crankshaft 26, a pressure rod 31 is pivotably connected to the connecting rod 28. The pressure rods 31 as shown in the exemplary embodiment of FIG. 1 are axially movably supported on the frame 21 via hollow-cylindrical guide structures 32. The pressure rods 31 carry a carrier bracket 33 on which the downholder 23 is mounted. The two pressure rods 31 extend parallel to each other in the clamping direction 30. The downholder 23 is arranged on the carrier bracket 33 in the center between the two pressure rods 31. The downholder 23 has a hollow-cylindrical shape and its axis extends in the clamping direction 30.

Concentrically, with the tubular downholder 23 a deep-draw plunger 36 is provided. The deep draw plunger 36 is operated via a separate plunger drive 56. The deep draw plunger 36 is provided for the deep-draw pressing of a pot-shaped blank 37 (also called "cup") in order to form from the blank 37 the can body. The deep-draw plunger is operated by a plunger drive 56. The plunger drive 56 is not mechanically coupled for movement with the drive arrangement 22 for the downholder. The plunger drive 56 and the drive arrangement 22 are controllable independently of each other.

For rotating the crankshafts 26 about the crankshaft axes 25 each of the crankshafts 26 has a crankshaft gear 40 mounted thereon. Each crankshaft gear 40 is in engagement with a driven gear 41 which is supported on the frame 21. In order to synchronize the movement of the two crankshafts 26 also the two driven gears 41 are in engagement with each other, one of the driven gears 41 is driven by a drive gear 42 by a motor, for example, an electric motor 43 in the form of a synchronous motor.

The arrangement 20 further includes a lower tool part 45 which is shown in the figure schematically as a single part. It is to be understood that the lower tool part 45 may also consist of an arrangement of several separate parts.

The lower tool part 45 comprises a counter element 46 which is stationary with respect to the frame 21 and which cooperates with the downholder 23. The counter element 46 is arranged at a fixed location. The counter element 46 is, for example, in the form of an annular counter support surface area 47 disposed on the lower tool part 45. The lower tool part 45 is provided with a cylindrical cavity 48. The cavity 48 is annularly surrounded by the counter support surface 47. The axes of the cavity 48 of the downholder 23 and of the draw plunger 36 coincide and form a common longitudinal axis L.

For the manufacture of the can body, the downholder 23 and the drawing plunger 36 are first removed from the lower tool part 45. To start a pot-shaped blank 37 is supplied by a supply system which is not shown. The counter support surface 47 is partially limited by a structure 38 which forms an abutment area for the blank 37 for forming a positioning reference for the blank 37 coaxially with the longitudinal axis L. The downholder 23 is in its rest position FP which is spaced from the lower tool part 45 sufficiently for permitting the insertion of the blank 37. Subsequently, the downholder 23 is moved by the drive arrangement 22 to its clamping position EP in which it engages the blank 37 and rests on the bottom 37*a* of the blank 37 so that the blank 37 is engaged between the downholder 23 and the counter support surface 47. The downholder 23 is at least partially surrounded by the cylindrical wall 37*b* of the blank 37. The front face of the downholder 23 presses herein onto an annular area of the bottom 37*a* next to the cylindrical wall 37*b*. During movement of the downholder 23 from the rest position FP to the clamping position EP, the drive arrangement 22 controls a position value which determines the position or the position change, for example, the speed of the downholder 23. As soon as the clamping position EP has been reached, the drive arrangement 22 controls, instead of a position value, a force value so that the clamping force F(t) assumes a certain value or follows a certain curve. Subsequently, the deep draw plunger 36 is moved through the hollow cylindrical downholder 23 into the cavity 48 wherein the blank 37 is pulled completely into the cavity 48. The blank 37 is pulled out between the downholder 23 and the counter support surface 47 while overcoming the engagement force F(t) whereby the can body is formed.

Figure 6:
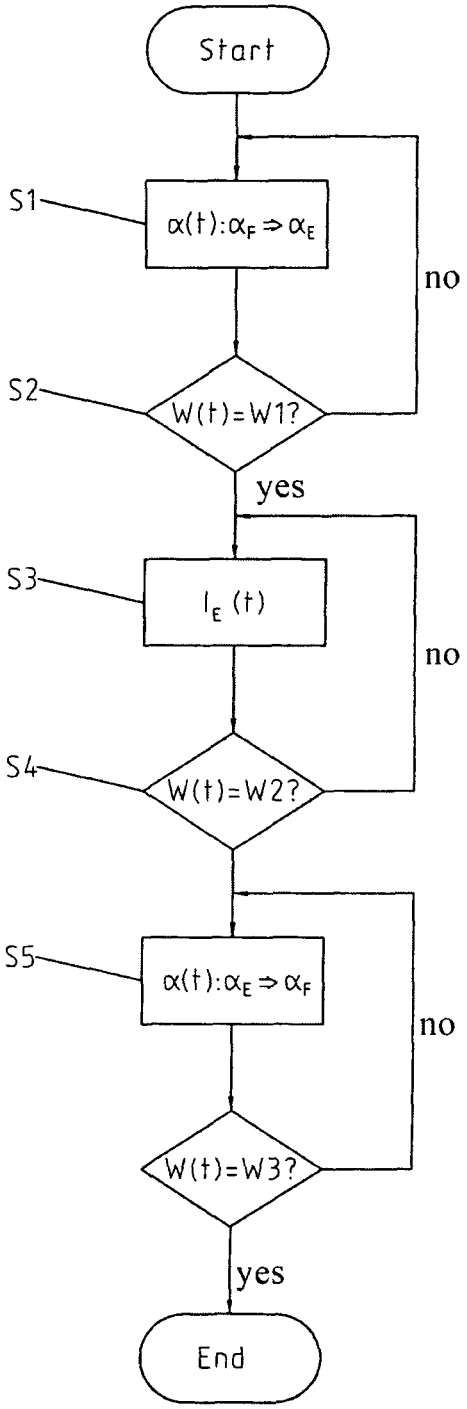
FIG. 6 is a block diagram of the method steps of the method according to the invention.

For careful treatment of the material of the blank and to avoid the formation of fractures of folds in the can body manufactured, the control the pressure application or respectively the movement of the downholder 23 by the drive arrangement 22 is important. An exemplary embodiment of such a control by the drive arrangement 22 is shown in FIG. 6. The drive arrangement 22 may include a control unit 55 for controlling the downholder 23 or it may be controlled by a control unit 55. As control unit, for example, a microprocessor may be used.

As guide value for operating condition changes of the drive unit 22 a virtual guide angle W(t) is used which has, for example, a time-based sine-shaped course with constant circle frequency w:

$$W(t)=\text{sine}(\omega t).$$

Figure 3:
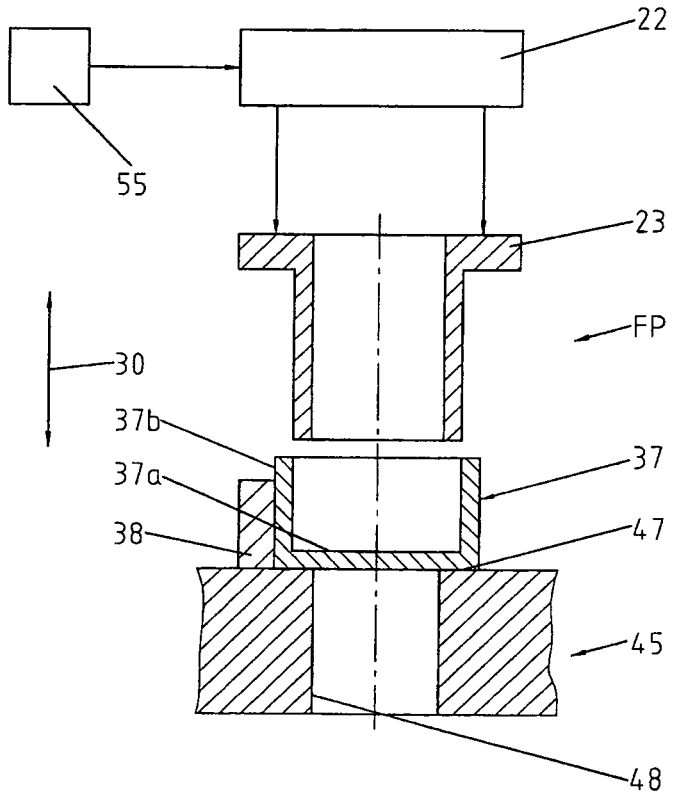
FIG. 3 is a block diagram-like representation of an exemplary embodiment with a downholder shown in its rest position.
Figure 4:
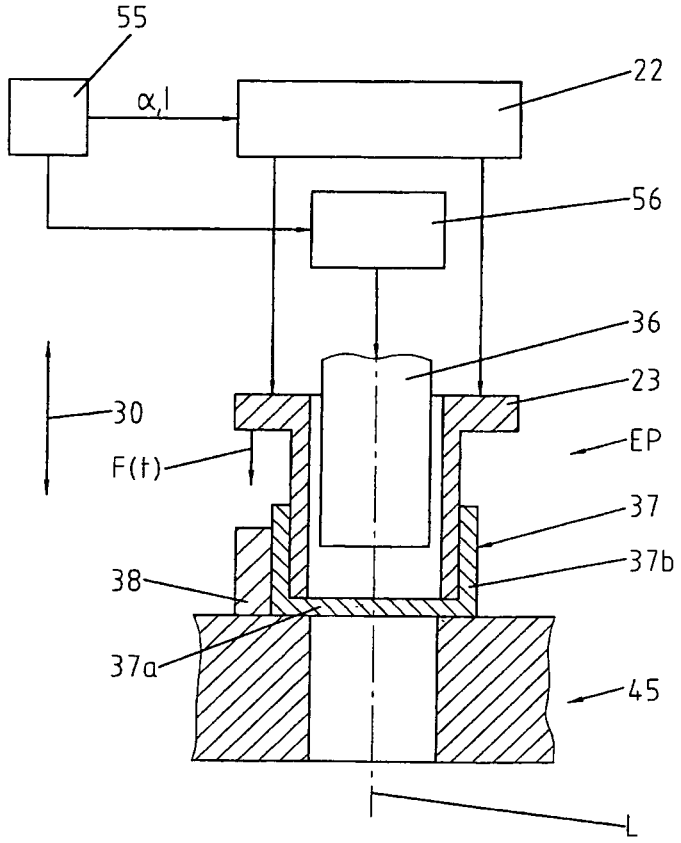
FIG. 4 is a block diagram-like representation of an exemplary embodiment of the invention with a downholder in its clamping position.

It is assumed that at the beginning of the procedure is disposed in its rest position FP remote from the lower tool part 45, (FIG. 3). The electric motor 43 is then in its start-out angular position $\alpha_F$. After start-up of the procedure, in a first step S1, the position value for the adjustment of the position of the downholder 23 is controlled. This occurs by the control of the angular position $\alpha(t)$ or respectively $\alpha(W(t))$ of the electric motor 43. To this end, the electric motor 43 is operated until it has reached an angular position $\alpha_E$ corresponding to the clamping position EP. The plus or minus sign of the voltage U indicates the direction of rotation of the electric motor 43. The reaching of the clamping position EP is evaluated in a second step S2. As long as the rotational position $\alpha_E$ corresponding to the clamping position EP has not been reached, the electric motor continues to be operated in the first step S1. The rotational angle $\alpha(t)$ of the electric motor 43 can change in accordance with a predetermined curve as it is shown, for example, in FIG. 7. The first deduction (inclination) of the rotational angle indicates the angular speed of the electric motor 43. The second time based deduction of the rotational angle indicates the angular acceleration. The rotational angle $\alpha(t)$ is dependent on the guide angle W(t) in such a way that a shock-free stopping of the downholder 23 occurs in the area of the exit position FP and, particular, in the entrance position EP. To this end, the course of the rotational angle $\alpha(t)$ is so defined that the angular acceleration includes no jumps.

If in the second step S2, it is determined that the electric motor 43 has reached the predetermined rotational position $\alpha_E$ and the downholder is in the engagement position EP, the procedure is continued in a third step S3. This is the case when the guide angle W(t) has reached a first predetermined guide angle value W1. The reaching of the engagement position EP can alternatively or additionally to the evaluation of the guide angle W(t) occur also by rotational position switches at the electric motor 43.

Figure 8:
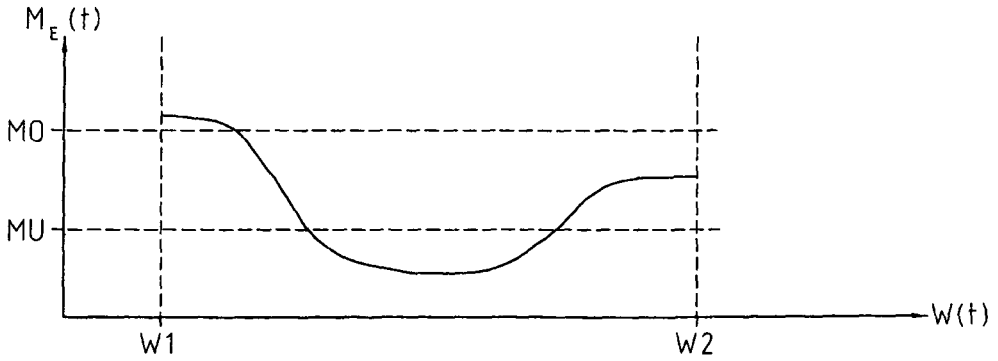
FIG. 8 is an exemplary curve indicating the motor torque during a torque controlled operation based on the guide angle.

In the third step S3, the control unit 55 switches the drive arrangement 22 from a position control to a force or torque control. The drive arrangement 22 then controls the motor current I to a desired current value $I_E(t)$ depending on the guide value W or, respectively, depending on the time t whereby the torque M of the electric motor 43 assumes the desired torque value $M_E(t)$. An exemplary course for the desired torque value $M_E(t)$ is shown in FIG. 8. The desired torque value $M_E(t)$ has, after the clamping position EP has been reached at the first guide angle value W1, an amount which is greater than the size of an upper threshold value MO. In the further time-based course, the desired torque value $M_E(t)$ drops below the upper desired threshold value MO only after the deep-draw plunger 36 has reached the bottom of the blank 37. In this way, the engagement force F of the downholder 23 is within a certain period after the deep-draw plunger 36 has reached the bottom 37*a*, sufficiently large so that the plunger 36 can start with the deep-draw procedure.

Subsequently, the desired torque value $M_E(t)$ is lowered to a value which is below a lower threshold value. Before the upper rim of the wall 37*b* of the blank 37 is pulled through between the downholder 23 and the counter support surface 47 the desired torque value $M_E(t)$ is again increased until it exceeds the lower threshold value MU, so that it has a value between the lower threshold value MU and the upper threshold value MO.

Figure 2B:
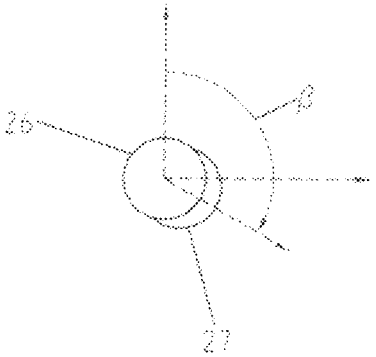
FIG. 2B is a schematic representation of the crank angle β of the crank shaft shown in FIG. 2A.

During the control of the torque $M_E(t)$ of the electric motor 43 for reaching a predetermined clamping force F(t) the conversion of the torque M to a clamping force F is to be considered. The clamping force F(t) generated by the downholder 23 is at the same torque M(t) of the electric motor 43 dependent on the crank 27 with respect to the crankshaft axis 25 (FIG. 2*b*). This non-linearity is well known.

In order to achieve a fast and reasonable control of the clamping force F(t) by controlling the motor torque M(t) as crank angle β and, consequently as rotational angle $\alpha_E$ of the electric motor 43 which corresponds to the clamping position EP of the downholder 23, a value in the range of 165° to 175° is predetermined. In this range, the change of the rotational angle α or respectively of the crank angle results in a particularly large change of the clamping force F(t). However, small changes of the motor current I(t) of the electric motor 43 are sufficient for the force control. This is very advantageous since the arrangement operates with very short cycle times of 120 to 150 ms, so that the electric motor 43 needs to be controlled very rapidly for the adjustment of the course of the desired motor torque $M_E(t)$.

Figure 7:
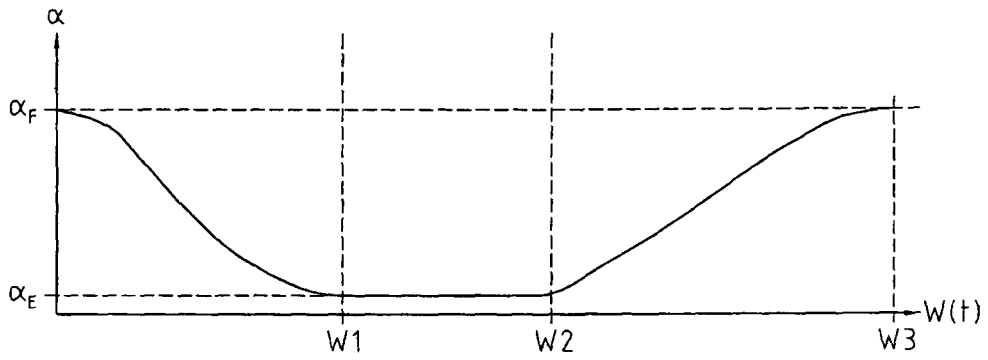
FIG. 7 is an exemplary curve indicating the position of the downholder depending on the guide angle.

As soon as the guide angle W(t) has reached a second predetermined guide angle value W2 (corresponding, for example, to the end of a predetermined period since reaching the clamping position EP) the control of the motor current $I_E(t)$ determining the force value is terminated. The downholder 23 is moved back from the engagement position EP to its rest position FP. To this end, in a fourth step S4 it is questioned whether the second predetermined guide angle value W2 has already been reached. If this is not the case, the motor current I of the electric motor 43 is controlled in a third step S3 to the desired current value $I_E(t)$ in order to obtain the desired torque $M_E(t)$. Otherwise, the method is continued in a fifth step S5 and the angular position $\alpha(t)$ of the electric motor 43 is changed in a direction opposite to that of the first step S1. In the process, the electric motor 43 is moved from rotational position $\alpha_E$ corresponding to its clamping position EP back to the start out rotational position $\alpha_F$ corresponding to the start-up position. Preferably, the rotational speed and/or the rotational acceleration of the electric motor 43 during movement of the downholder 23 out of the clamping position EP to the start-out or rest position FP is less than during movement of the downholder 23 out of the rest position FP to the clamping position EP. In FIG. 7 the curves are mapped to show the values of the guide angle W larger than the second guide angle value W2 and flatter than for values of the guide angle W smaller than the first guide angle value W1.

Finally, in a sixth step S6 it is examined whether the start-out rotational position $\alpha_F$ of the electric motor 43 was reached. To this end, it is interrogated whether the guide angle W(t) has reached a third predetermined guide angle value W3. Alternatively or additionally, a rotary position switch at the electric motor may be used. As long as this is not the case, the rotational position $\alpha(t)$ of the electric motor 43 is further changed in the fifth step S5. When the electric motor 43 has reached the desired rotational rest position $\alpha_F$ corresponding to the rest position FP of the downholder 23, the motor voltage is switched off and the procedure is terminated. The procedure described in FIG. 6 is performed cyclically for the processing of each blank 37.

During the third step S3, the deep draw plunger 36, which pulls the blank 37 into the cavity 48 is activated as long as the motor current I(t) of the electric motor 43 is controlled for the setting of the engagement force F(t). Herein the blank 37 is pulled out from between the downholder 23 and the counter support surface 47 while the respective value of the clamping force F(t) is maintained. It is essential herein that the clamping force is maintained at the desired course. In this way, it is ensured that the blank 37 does not rupture (which would happen with an excessive clamping force F) and also pleat formation in the finished can body is avoided (which would happen with an excessively low engagement force F).

Instead of an electric motor 43 also other servo-drives, for example, fluid cylinders, may be used for operating the downholder 23. The crank drive 24 then is not needed. As force value then the pressure P in the fluid cylinder is used. As position value the fluid volume V supplied to the fluid cylinder or the volume flow into or respectively out of the fluid cylinder may be used.

Figure 5:
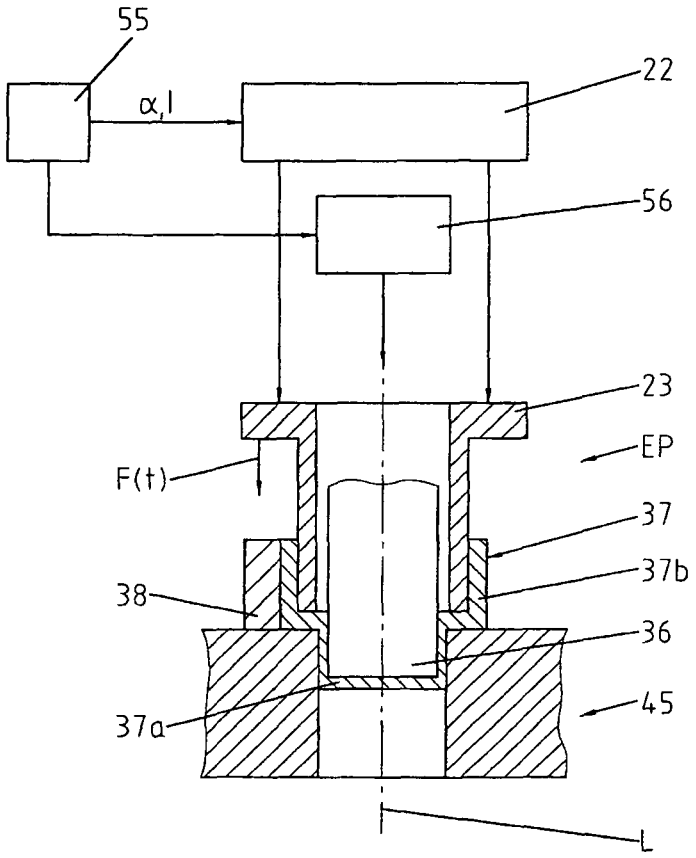
FIG. 5 is a block diagram like representation of the exemplary embodiment according to FIG. 4 with a downholder in its clamping position and with a deep-draw plunger deforming the blank.

As it is shown schematically in FIG. 5, the control unit 55 may at the same time be used for controlling the plunger drive 56 for the movement of the deep-draw plunger 36. In this way, the plunger drive 56 for the deep draw plunger 36 and the drive arrangement 22 for the downholder 23 can be coordinated in a simple manner. Via the control unit 55, the two drives 22, 56 can be jointly controlled in a predetermined interrelation as, for example, provided by the guide angle W(t).

The invention concerns an arrangement 20 and a method for the manufacture of can bodies from pot-shaped blanks 37. To this end, the blank 37 is inserted into a bottom tool part 45. The blank 37 is clamped between a downholder 23 and a counter support surface 47 of the lower tool part 45. For controlling a position value α determining the position and/or position change of the downholder 23, a drive arrangement 22 is provided. The drive arrangement controls the position value in accordance with a predetermined course, so as to move the downholder 23 into the clamping position or out of the clamping position EP. As soon as the downholder 23 reaches its clamping position EP, the drive unit 22 controls a force value in accordance with a predetermined course which determines the clamping force F(t) which is applied by the downholder 23 to the blank 37. This occurs preferably by an adjustment of the motor current I to a predetermined course of the desired value $I_E(t)$.

LISTING OF THE REFERENCE NUMERALS

20 arrangement
21 frame
22 drive arrangement
23 downholder
24 crank drive
25 crankshaft axis
26 crankshaft
27 crank
28 connecting rod
30 clamping arrangement
31 pressure rod
32 guide
33 carrier bracket
36 deep-draw plunger
37 blank
38 structure
40 crankshaft gear
41 driven gear
42 drive gear
43 motor
45 lower tool part
46 counter element
47 counter support surface
48 cavity
55 control unit
56 plunger drive
EP clamping position
F(t) clamping force
FP rest position
I motor current
$I_E(t)$ desired current value
L longitudinal axis
M torque
$M_E(t)$ desired torque
W(t) guide angle
W1 first guide angle value
W2 second guide angle value
W3 third guide angle value
S1-S6 steps 1 to 6
α(t) rotational position
β crank angle

What is claimed is:

1. Arrangement for the manufacture of can bodies, comprising:

a downholder (23) in operative arrangement with a counter element (46, 47), a pot-shaped blank (37) having a bottom (37*a*) in operative position between the downholder (23) and the counter element (46, 47) in a clamping position (EP), a deep-draw plunger (36) arranged co-axially with the downholder (23) in operative deep-draw pressing contacting arrangement with the pot-shaped blank (37) to deform the pot-shaped blank (37) into a can body, a drive arrangement (22) in operative movement arrangement with the downholder (23) in a clamping direction (30) between a starting position (FP) and the clamping position (EP), a plunger drive (56) in operative movement arrangement with the deep-draw plunger (36), the drive arrangement (22) including an electric motor (43) responsive to a motor current I(t) in operative arrangement with the downholder (23), means for reducing material stresses on the pot-shaped blank (37) by varying a clamping force (F(t)) on the pot-shaped blank (37) while in the clamping position (EP), wherein the means for reducing material stresses on the pot-shaped blank (37) by varying the clamping force (F(t)) on the pot-shaped blank (37) while in the clamping position (EP) comprises a control unit (55) in operative controlling arrangement with the electric motor (43) to control and to vary the clamping force (F(t)) on the pot-shaped blank (37) as follows:

to control as a force value the motor current I(t) of the electric motor (43) which determines a motor torque of the electric motor (43) and the clamping force (F(t)) on the pot-shaped blank (37) as soon as the downholder (23) reaches the clamping position (EP), and to control a rotational position value (α(t)) of the electric motor (43) which determines the position and/or the position change of the downholder (23) when the downholder (23) is outside the clamping position (EP), and to operate the downholder (23) such that, a. initially upon the downholder (23) reaching the clamping position (EP), before the deep-draw plunger (36) reaches the bottom (37*a*) of the pot-shaped blank (37), to provide the electric motor (43) with a predetermined desired motor torque value ($M_E$ (t)) greater than an upper predetermined threshold torque value (MO) of the electric motor (43); and, b. subsequently, upon the deep-draw plunger (36) reaching the bottom (37*a*) of the pot-shaped blank, to provide the electric motor (43) with a predetermined desired motor torque value ($M_E$ (t)) such that the predetermined desired torque ($M_E$ (t)) drops below the upper predetermined threshold torque value (MO) during the deformation of the pot-shaped blank by the deep-draw plunger (36) into the can body, whereby material stresses on the pot-shaped blank (37) are reduced during deep-draw pressing of the pot-shaped blank (37).

2. Arrangement according to claim 1, wherein the counter element (46, 47) is stationary.

3. Arrangement according to claim 1, wherein the control unit (55) in operative arrangement with the drive arrangement (22) via electric motor (43) to control the drive arrangement (22) by switching after the occurrence of a predetermined event (W2) from the control of the force value (I(t)) to the control of the rotational position value (α(t)) of the downholder (23).

4. Arrangement according to claim 1, wherein the control unit (55) further to control the rotational position (α(t)) of the electric motor (43) so that no angular acceleration jumps occur.

5. Arrangement according to claim 1, wherein the control unit (55) further to control the force value (I(t)) in accordance with a predetermined course while the downholder (23) is in the clamping position (EP).

6. Arrangement according to claim 1, wherein the control unit (55) in controlling the rotational position value (α(t)) of the electric motor (43), the control unit (55) utilizes a virtual guide angle W(t) where W(t)=sine (ωt) and (α(t)) is equal to (α(W(t)).

7. Arrangement according to claim 1, wherein the control unit (55) further to control the plunger drive (56).

* * * * *